United States Patent [19]

Ozaki et al.

[11] Patent Number: 5,008,504

[45] Date of Patent: Apr. 16, 1991

[54] SWITCHING MECHANISM IN CIRCUIT BREAKER

[75] Inventors: Seishiro Ozaki; Nobuo Asahi; Tsuneo Ebisawa, all of Kanagawa, Japan

[73] Assignee: Fuji Electric Co., Ltd., Kanagawa, Japan

[21] Appl. No.: 459,363

[22] Filed: Dec. 29, 1989

[30] Foreign Application Priority Data

Jan. 6, 1989 [JP] Japan ..... 64-966

[51] Int. Cl.[5] ..... H01H 5/06

[52] U.S. Cl. ..... 200/401; 200/322; 200/327

[58] Field of Search ..... 200/401, 400, 321-327

[56] References Cited

U.S. PATENT DOCUMENTS

| | | | |
|---|---|---|---|
| 3,155,803 | 7/1962 | Klein et al. | 200/401 |
| 3,239,638 | 3/1966 | Gryctko et al. | 200/327 X |
| 4,546,224 | 10/1985 | Mostosi | 200/401 |
| 4,588,878 | 5/1986 | Klein et al. | 200/327 X |
| 4,641,001 | 2/1987 | Fujihasa et al. | 200/327 X |
| 4,645,891 | 2/1987 | Changle | 200/401 |
| 4,786,711 | 11/1988 | Iio et al. | 200/401 |

FOREIGN PATENT DOCUMENTS 57-98945 6/1982 Japan .

*Primary Examiner*—Ernest G. Cusick

*Attorney, Agent, or Firm*—Finnegan, Henderson, Farabow, Garrett, and Dunner

[57] ABSTRACT

A switching mechanism in a circuit breaker having a latch being locked from moving when the circuit breaker is in a normal "on" state, a toggle link having a striking part being coupled to the latch and elastically urged with an elastic force by a switching spring at times when the circuit breaker is in the normal state and released from said urge at times when the circuit breaker is tripped or changed from the normal state to a tripped "off" state, and a stopper disposed adjacent the striking part of the toggle link in that when the circuit breaker is tripped, the latch is released to cause the striking part of the toggle link strike the stopper intermediate in the tripping action so that the time required for completing the tripping of the circuit is reduced.

7 Claims, 4 Drawing Sheets

SWITCHING MECHANISM IN CIRCUIT BREAKER

BACKGROUND OF THE INVENTION

A. Field of the Invention

This invention relates to a switching mechanism in a circuit breaker.

B. Description of the Prior Art

A switching mechanism in a circuit breaker is known in the art in that a toggle link is provided between a latch locked by a trip mechanism and a holder bearing a movable contact. The toggle link is elastically urged by a switching spring which is elastically stressed when the circuit breaker is turned on or engaged to complete the circuit. When the circuit breaker is tripped, the latch is released from the trip mechanism and the elastic force of the switching spring moves the toggle link past a dead zone so that the movable contact is disengaged from the stationary contact by a snap action of known type. The dead zone refers to a state wherein the movable contact is stably engaged with the stationary contact. For example, Japanese Patent Application No. 98945/1982 discloses such a switching mechanism.

However, in the foregoing conventional switching mechanism, the disengagement of the movable contact from the stationary contact is effected only after the elastic force of the switching spring produces motion past the dead zone, thus resulting in an excessive tripping time. Therefore, in order to reduce the tripping time, it is essential to cause the elastic force to move the switching mechanism past the dead zone as quickly as possible once the tripping of the circuit breaker commences.

SUMMARY OF THE INVENTION

The present invention overcomes the problem of this excessive tripping time of the prior art in that the elastic force of the switching spring in the switching mechanism of the present invention produces motion which passes the dead zone much more quickly, thereby substantially reducing the tripping time.

To achieve the object and in accordance with the purpose of the invention, as embodied and broadly described herein, in one embodiment of the switching mechanism of the present invention, a casing is provided therein. A holder is movably coupled to the casing and movably holds a movable contact. The movable contact engages a stationary contact at times when the circuit breaker is in a normal "on" state and disengages the stationary contact at times when the circuit breaker is a tripped "off" state. A movable latch is coupled to the casing, and is locked from moving at times when the circuit breaker is in the normal state.

Further, in the switching mechanism of the present invention, a toggle link has upper and lower link portions which are movably coupled to one another. The upper link portion is coupled to the latch, and the lower link portion is coupled to the holder. The upper link portion has a striking part. The toggle link and the latch are relatively pivoted for a snap action. The toggle link is subjected to an elastic force applied in a stable direction within a dead zone by a switching spring at times when the circuit breaker is in the normal state, and subjected to a rapid variation from the stable direction resulting in the direction of the elastic force leaving the dead zone at times when the circuit breaker is in the tripped state. The stable direction refers to a direction of the elastic force of the switching spring when the movable contact is stably engaged with the stationary contact.

A stopper is fixedly formed on the casing adjacent the upper link portion of the toggle link. The striking part of the upper link portion and the stopper are relatively positioned so that the striking part of the upper link portion strikes the stopper intermediate in the tripping action to shorten a radius about which a portion of toggle link pivots.

In another embodiment of the switching mechanism of the present invention, a swingable latch is held latched by a tripping mechanism when the circuit breaker is set in the normal state. A swingable holder supports a movable contact. A toggle link has an upper link portion that is coupled to the latch and a lower link portion that is coupled to the holder. The upper and lower link portions are coupled through a toggle shaft. A swingable handle lever is movably mounted on the casing, and a switching spring is connected between the handle lever and the toggle shaft. When the circuit breaker is tripped, i.e., changed from the normal state to the tripped state, the latch is released from the tripping mechanism and swung to move the upper link portion of the toggle link such that the elastic force of the switching spring exceeds the dead zone, and the movable contact is disengaged from the stationary contact.

Further, a stopper is fixedly formed on the casing adjacent the upper link portion of the toggle link. The upper link portion has a striking part in that the stopper is struck by the striking part when the upper link portion is moved. As mentioned above, the upper link portion is moved when the circuit breaker is tripped and as a result, the latch is swung.

When the striking part of the upper link portion is caused to strike the stopper, the upper link portion of the toggle link is swung about a shortened radius with respect to the point of striking, and the switching action is accelerated.

The accompanying drawings, which are incorporated in and constitute a part of this specification, illustrate one embodiment of the invention and together with the description, serve to explain the principle of the invention.

DESCRIPTION OF A PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

Figure 1:
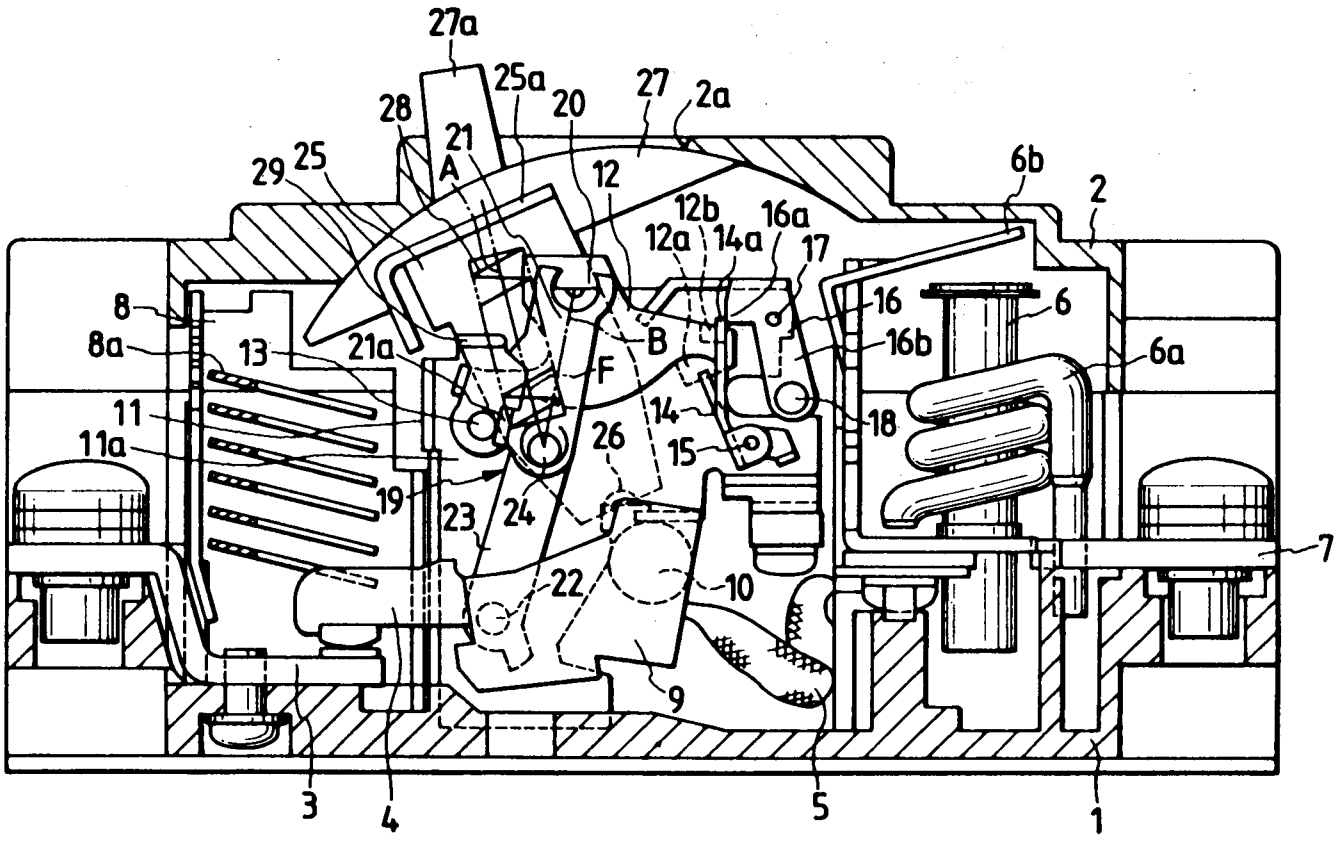
FIG. 1 is a longitudinal cross sectional view of a switching mechanism according to an embodiment of the present invention.

FIG. 1 is a longitudinal cross sectional diagram showing a circuit breaker, or a three-pole wiring interrupter, with a switching mechanism according to the present invention, when the circuit breaker is in a normal "on" state. The arrangement of the components shown in FIG. 1 is for the central pole.

A casing 1, which is molded from a resin, and a cover 2 house the components described below. A stationary contact 3 is integrally coupled to a power source terminal (not shown). A movable contact 4 movably engages and disengages stationary contact 3. A lead wire 5 has one of two opposite ends connected to movable contact 4. An overcurrent trip device 6 is surrounded with a trip coil 6*a*. Trip coil 6*a* has one end connected to another end of lead wire 5 and another end connected to a load terminal 7. These foregoing components form a current flow path in the circuit breaker. Further, casing 1 and cover 2 house an arc extinguishing chamber 8 having a grid 8*a*.

Movable contact 4 is movably coupled to a holder 9 through a shaft (not shown), and is urged by a contact spring (not shown) towards stationary contact 3. Holder 9, which is molded from a resin and integrally coupled to a switching shaft 10, is swingably mounted on casing 1 through switching shaft 10. Switching shaft 10 couples the central pole portion of the circuit breaker to the right and left pole portions.

A frame 11, which is made of an iron plate, has two side boards 11*a* on opposite sides, and lower end portions fixedly secured to casing 1 with screws (not shown). The components of the switching mechanism and the tripping mechanism are mounted on the frame 11 as described below.

In FIG. 1, a latch 12 is swingably mounted on side boards 11*a* through a latch shaft 13. Latch 12 has left and right arms 12*a* and 12*b*, respectively. Left arm 12*a* is shown in two-dot chained lines. Left arm 12*a* is positioned opposite right arm 12*b*. The end portion of left arm 12*a* is normally locked by a latch keeper 14.

Latch keeper 14 is rotatably mounted on side boards 11*a* through a shaft 15. Latch keeper 14 has an L-shaped end (not shown) extending substantially perpendicular to the surface of side boards 11*a* to engage the end portion of left arm 12*a*. Latch keeper 14 is urged to rotate clockwise by latch 12, which operation will be described later. However, the rotation of latch keeper 14 is stopped by a pawl 16.

Pawl 16 forms a tripping mechanism together with latch keeper 14. Pawl 16 is swingably supported by side boards 11*a* gages an end portion 14*a* of latch keeper 14 on the rear side of an end portion of keeper 14 adjacent pawl 16.

The force of latch keeper 14 acting on pawl 16 is transferred to the center of shaft 17 so that pawl 16 is maintained in a position as shown in FIG. 1 by a weak counterclockwise elastic force of a torsion spring (not shown) connected to pawl 16. Pawl 16 has an arm 16*b*, which has a cross bar 18 extended to the right and left poles. Cross bar 18 is disposed facing the operating end of an armature 6b of overcurrent trip device 6.

A toggle link 19 is coupled to latch 12 and holder 9. Toggle link 19 has an upper link portion 21 which is coupled to latch 12 through a semi-circular shaft piece 20, and a lower link portion 23 which is coupled to holder 9 through a shaft 22. Upper link portion 21 is coupled to lower link portion 23 through a shaft 24. Shaft piece 20 is integrally fixed to latch 12.

Figure 2A:
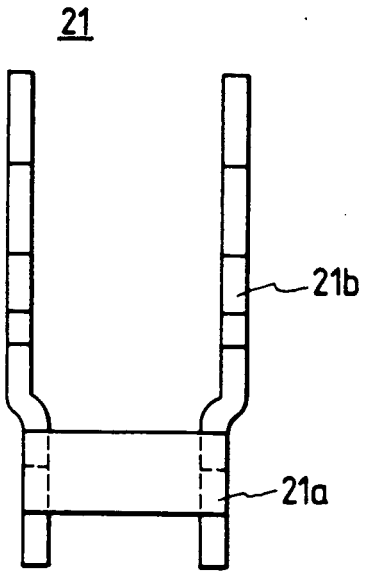
FIG. 2(*a*), 2(*b*), and 2(*c*) show an enlarged front view, side view and plan view of the upper link portion of the toggle link of the switching mechanism of FIG. 1, respectively.
Figure 2B:
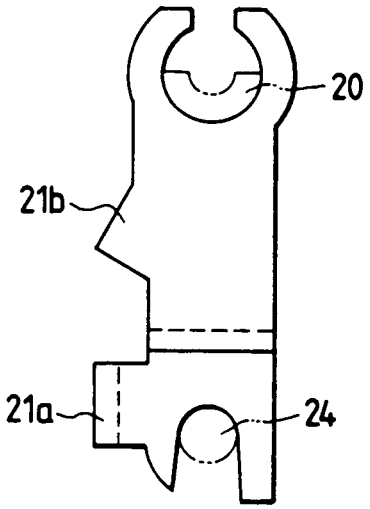
Figure 2C:
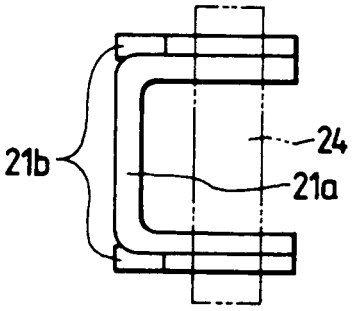

FIG. 2(*a*) shows a cross section view of upper link portion 21, FIG. 2(*b*) a side view, and FIG. 2(*c*) a plan view thereof. Upper link portion 21 has right and left arms which are spaced from one another. These arms are coupled through a U-shaped part 21*a*. Striking part 21*b* is protruded outwardly from the front end of each of the right and left arms, which operation will be described later. As shown in FIG. 1, upper link portion 21, which is yoke-shaped, is coupled to latch 12. Lower link portion 23, which is also yoke-shaped, is coupled to upper link portion 21.

When the circuit breaker is in the normal state, as shown in FIG. 1, the rear surface of U-shaped part 21*a* of upper link portion 21 adjacent shaft 13 is abutted against both opposite ends of shaft 13 supporting latch 12 so that toggle link 19 is stopped from being bent to the left, as shown in FIG. 1.

In FIG. 1, a yoke-shaped handle lever 25 has a U-shaped upper end portion 25*a* having two arms extending therefrom. Each of the two arms has a semi-circular recess in a lower end portion away from upper end portion 25*a*. The recesses are engageable with semcircular shaft pieces 26 fixedly mounted on side boards 11*a* and protruded inward therefrom substantially perpendicular thereto so that handle lever 25 is swingable in the lateral direction of side boards 11*a* as shown in FIG. 1.

An operating handle 27 is fixedly secured to the upper end of handle lever 25. Operating handle 27 has a knob 27*a* extended through a window opening 2*a* formed in casing 2. Knob 27*a* is shifted in window 2*a* to the left and right side thereof along the lateral direction of side boards 11*a*, to the circuit breaker either in the normal state or a tripped "off" state, respectively.

A switching spring 28, shown depressed in zig zag lines in FIG. 1 and the middle portion thereof hidden by latch 12, is interposed between the right and left arms of upper link portion 21 connecting the top of handle lever 25 and toggle shaft 24, one of two opposite ends of switching springs 28 are connected under tension to U-shaped part 25*a* of handle lever 25 and another end to toggle shaft 24, respectively.

When the circuit breaker is in the normal state, as shown in FIG. 1, an elastic tension force F of switching spring 28 acting on toggle shaft 24 causes upper link portion 21 to rotate clockwise around shaft piece 20, and in turn causes lower link portion 23 to push movable contact 4 against stationary contact 3. Latch 12 is urged through shaft piece 20 by elastic force F of switching spring 28 to swing substantially counterclockwise around shaft 13. Latch 12 causes latch keeper 14 to rotate clockwise around shaft 15, but, the rotation of latch keeper 14 is stopped by pawl 16.

When operating handle 27 is moved to cause the circuit breaker change from the normal state to the tripped state by swinging handle lever 25 clockwise, a straight line B, which connects the centers of shaft piece 20 and toggle shaft 24, is moved to coincide with a line of action A of elastic force F of switching spring 28 shown in FIG. 1, i.e., the motion of action line A exceeds the dead zone. The direction of elastic force F acting on upper link portion 21 is reversed to cause upper link portion 21 to rotate counterclockwise. As a result, lower link portion 23 rotates clockwise about shaft 22, quickly raising movable contact 4 from, and disengaging, stationary contact 3.

The disengagement of movable contact 4 from stationary contact 3, which is caused by force F being applied along an axis just past the dead zone, also occurs when an excessive current such as short-circuit current flows in the current path of the circuit breaker to actuate overcurrent trip device 6. When overcurrent trip device 6 is actuated, armature 6*b* is moved to strike cross bar 18, thereby to cause pawl 16 to rotate clockwise. As a result, pawl 16 is disengaged from latch keeper 14. Then, latch keeper 14 is swung clockwise to release latch 12. Latch 12 is rotated counterclockwise by elastic force F of switching spring 28 acting thereupon through upper link portion 21. As a result, straight line B is swung to coincide with, and just past, the line of action A, in a substantially counterclockwise direction, i.e. line of action A then exceeds the dead zone. This will be described with reference to FIGS. 3, 4 and 5 in more detail below.

Figure 4:
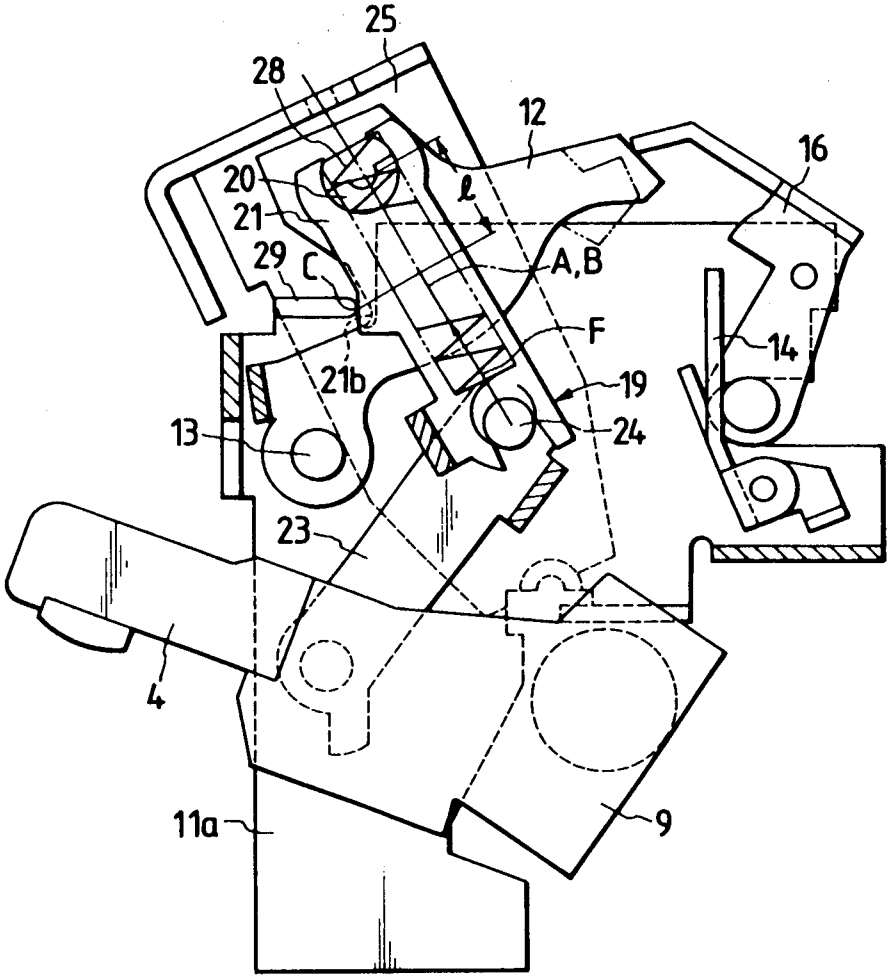
FIG. 4 is an enlarged view of the switching mechanism of FIG. 1 when the dead zone is just exceeded.
Figure 3:
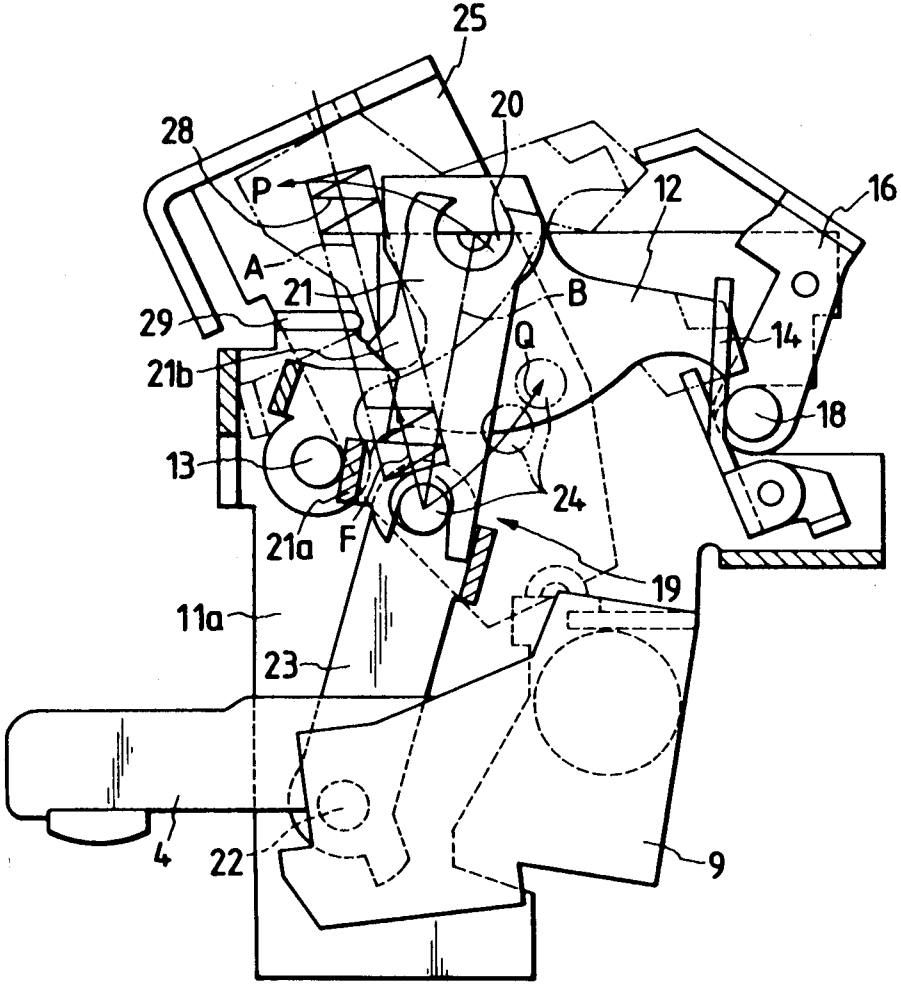
FIG. 3 is an enlarged view of the switching mechanism of FIG. 1 when the tripping of the circuit breaker commences.
Figure 5:
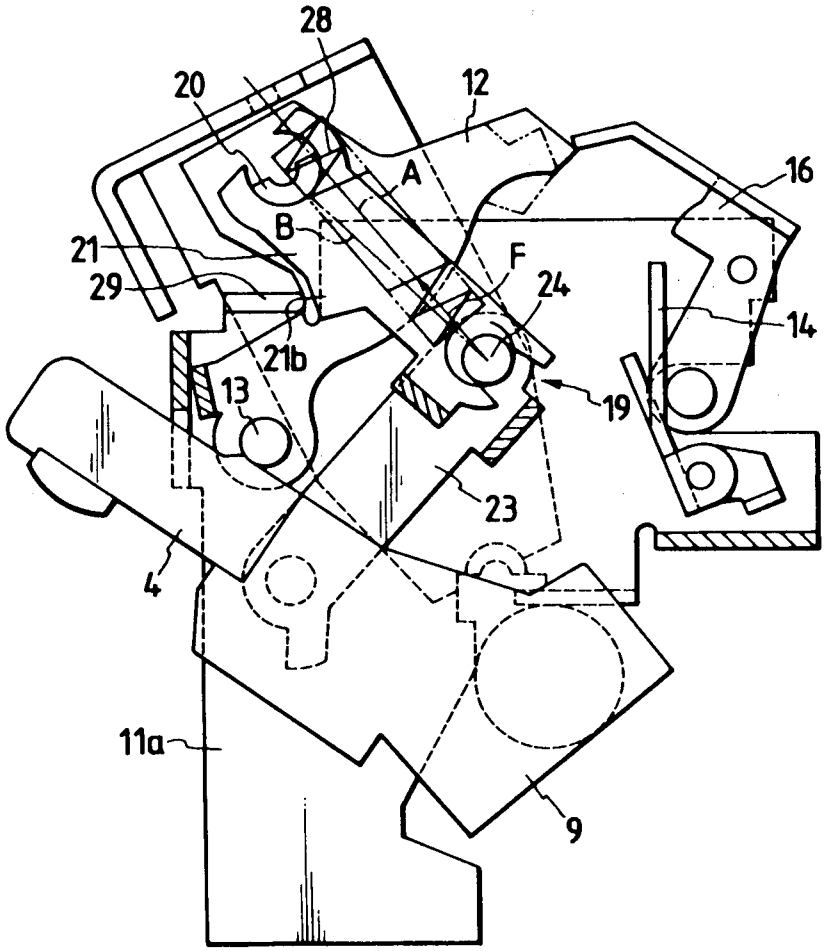
FIG. 5 is an enlarged view of the switching mechanism of FIG. 1 when the tripping of the circuit breaker is completed.

FIGS. 3, 4, and 5 are enlarged views of the switching mechanism and the tripping mechanism of FIG. 1. More specifically, FIG. 3 shows the state of these mechanisms when the tripping of the circuit breaker commences or the circuit breaker is switched from the normal state to the tripped state. FIG. 4 shows the states of the mechanisms when the tripping is fully effective (the action line exceeds the dead zone). FIG. 5 shows the state of the mechanisms when the tripping is completed.

In FIG. 3, armature 6*b* strikes cross bar 18, and pawl 16 is rotated clockwise. Then, latch 12 is swung counterclockwise around shaft 13 by the tension in spring 28, and simultaneously, the center of shaft piece 20 is moved along the direction of an arrow along an arc of shape P. Toggle shaft 14 connecting upper link portion 21 and lower link portion 23 is moved along the direction of an arrow along a curve of shape Q. Each of two positions of toggle shaft 24 is shown in two-dot chain lines in FIG. 3, corresponding to its positions in FIGS. 4 and 5, respectively. On the other hand, upper link portion 21 having two opposite ends coupled to shaft piece 20 and toggle shaft 24 is caused to move along the direction indicated by arrows P and Q.

A stopper 29 is provided adjacent upper link portion 21. Stopper 29 comprises an inwardly bent upper portion of side board 11*a* of frame 11, and a rounded front end portion thereof adjacent upper link portion 21. Striking part 21*b* of upper link portion 21 is caused to strike stopper 28 during the movement of upper link portion 21. Stopper 29 stops the swing of latch 12.

FIG. 4 shows the state of the switching mechanism and the tripping mechanism after striking part 21*b* of upper link portion 21 strikes stopper 29, and elastic force F causes motion exceeding the dead zone with respect to toggle link 19, i.e., straight line B is moved to coincide with, and just past, line of action A of elastic force F. The time required for the foregoing to happen is substantially less than the switching time required in the conventional switching mechanism which does not provide striking part 21*b* with respect to stopper 29, thus providing no intermediate striking in the breaker action.

As described above, the two opposite ends of upper link portion 21 are moved along arrows P and Q, respectively, when the circuit breaker is tripped. Straight line B, connecting the centers of shaft piece 20 and toggle shaft 14, is swung counterclockwise, and line of action A of elastic force F is swung somewhat counterclockwise, i.e., the lower end adjacent toggle shaft 24 of upper link portion 21 is moved along arrow Q; and handle 25, to which the upper end of spring 28 is connected, is fixed and unmoved.

In FIG. 4, striking part 21*b* of upper link portion 21 strikes stopper 29 before the dead zone is reached, and upper link portion 21 is caused to swing counterclockwise with respect to a striking point C. A length 1 of a respective arm of upper link portion 21 that is swung is shorter than the entire length of the respective arm of upper link portion 21. As a result, the ratio of the angle of swing of upper link portion 21 to the displacement of shaft piece 20 along arrow P shown in FIG. 3 is substantially increased as compared to the ratio in the conventional switching system. Therefore, soon after straight line B coincides with, and moves just part, line of action A, this quicker rotation starts. In addition, because of an abrupt nature of the swing of upper link portion 21, the angle of swing of movable contact 4, when disengaging stationary contact 3, is substantially increased when line of action A exceeds the dead zone.

Figure 6:
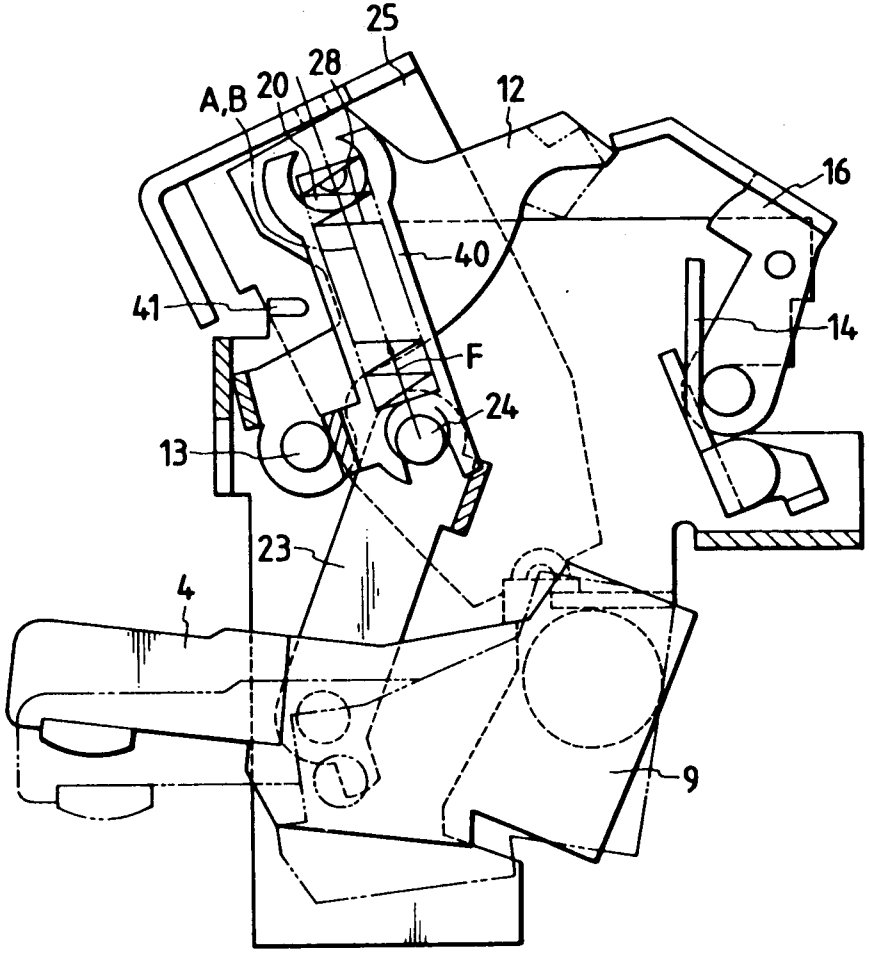
FIG. 6 PRIOR ART
FIG. 6 is an enlarged view of a conventional switching mechanism.

FIG. 6 shows the state of the conventional structure when the circuit breaker is tripped and as a result the line of action reaches the dead zone. An upper link portion 40 does not provide a striking part, and stopper 41 merely stops latch 12. In contrast, in FIG. 4, striking part 21*b* of upper link portion 21 strikes stopper 29 even before the dead zone is reached. Moreover, the dead zone is reached with a smaller angle of swing of latch 12 after the tripping of the circuit breaker commences, and the angle of swing of movable contact 4 is increased.

FIG. 5 shows the state of the switching mechanism and the tripping mechanism when the tripping of the circuit breaker is completed. Line of action A still exceeds the dead zone, and movable contact 4 has been further raised, as compared to FIG. 4, because the motions along P and Q continued, striking part 21*b* is spaced from stopper 29, and latch 12 is now in contact with stopper 29.

According to the present invention, the time required for elastic force F to cause motion past the dead zone is substantially reduced. Since the critical rotation of toggle link 19 is about a shorter radius, the time required for disengaging movable contact 4 from stationary contact 3 is substantially reduced.

Moreover, the effective completion of the tripping of the circuit breaker is carried out with a smaller angle of swing of latch 12 than in the conventional switching mechanism (compare FIGS. 4 and 6). Both the angle of swing of latch 12 and that of handle lever 25 required for completing the tripping of the circuit breaker are substantially reduced. Therefore, the components of latch 12 and handle lever 25 can be placed closer, thus, allowing the circuit breaker made more compact than in the conventional system.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A switching mechanism in a circuit breaker, comprising:

a casing;

means movably coupled to the casing for movably holding a movable contact, said movable contact engaging a stationary contact at times when the circuit breaker is in a normal state and disengaging the stationary contact at times when the circuit breaker is a tripped state;

a latch coupled to the casing, said latch being located from moving at times when the circuit breaker is in the normal state;

a toggle link having upper and lower link portions being movably coupled to one another, said upper link portion having a striking part, said upper link portion being coupled to said latch, said lower link portion being coupled to said holding means, said toggle link and said latch being relatively pivoted for a snap action, said toggle link being subjected to an elastic force applied in a stable direction within a dead zone by a switching spring at times when the circuit breaker is in the normal state, and being subjected to a rapid variation from the stable direction resulting in the direction of the elastic force leaving the dead zone at times when the circuit breaker is in the tripped state; and a stopper fixedly formed on the casing adjacent said upper link portion of said toggle link, said striking part of said upper link portion and said stopper being spaced a distance from one another at times when the circuit breaker is in the normal state, and being relatively positioned so that said striking part strikes said stopper intermediate in the tripping action to shorten a radius about which a portion of the toggle link pivots, thereby to accelerate the tripping action.

2. The switching mechanism of claim 1, further including a handle lever with respect to which said elastic force is applied, whereby motion of the handle is effective to move the line of action of the elastic forces to initiate the tripping action.

3. The switching mechanism of claim 1, wherein each of said upper and lower link portions of the toggle link have two arms, each arm being spaced from and coupled to the other.

4. The switching mechanism of claim 1, wherein said striking part of said upper link portion of the toggle link is protruded from the upper link portion.

5. The switching mechanism of claim 1, wherein the relative pivoting of said toggle link and latch provides that the latch rides against said stopper when the tripping of the circuit breaker is completed, and the toggle link is spaced a distance from the stopper.

6. A switching mechanism in a circuit breaker, comprising:

a casing;

a swingable latch coupled to the casing being locked from moving at times when the circuit breaker is in a normal state;

means movably coupled to the casing for movably holding a movable contact, said movable contact conductively engages a stationary contact at times when the circuit breaker is in the normal state and disengages the stationary contact at times when the circuit breaker is in a tripped state;

a toggle link having a upper link portion that is coupled to the latch and a lower link portion that is coupled to said holding means, the upper and lower link portions being relatively pivoted for a snap action around a toggle shaft;

a swingable handle lever movably mounted on the casing;

a switching spring being connected between the handle lever and the toggle shaft, said toggle link being subjected to an elastic force applied in a stable direction within a dead zone by said switching spring at times when the circuit breaker is in the normal state, and being subjected to a rapid variation from the stable direction resulting in a direction of the elastic force leaving the dead zone at times when the circuit breaker is in the tripped state, whereby when the circuit breaker is tripped or changed from the normal state to the tripper state, said latch is swung to move the upper link portion of the toggle link such that the elastic force of the switching spring exceeds the dead zone, and the movable contact is disengaged from the stationary contact; and a stopper being fixedly formed on the casing adjacent the upper link portion of the toggle link, said upper link portion having a striking part which is spaced a distance from the stopper at times when the circuit breaker is in the normal state whereby the stopper is struck by the striking part intermediate in the tripping action to shorten a radius about which a portion of the toggle link pivots at times when the circuit breaker is tripped.

7. A method for tripping a circuit breaker having a switching mechanism, which includes a casing; means movably coupled to the casing for movably holding a movable contact, said movable contact engaging a stationary contact at times when the circuit breaker is in a normal state and disengaging the stationary contact at times when the circuit breaker is a tripped state; a latch being coupled to the casing and locked from moving at times when the circuit breaker is in the normal; a toggle link having a striking part being coupled to said holding means, said toggle link and said latch being relatively pivoted for a snap action, said toggle link being subjected to an elastic force applied in a stable direction within a dead zone by a switching spring at times when the circuit breaker is in the normal state, and being subjected to a rapid variation from the stable direction resulting in the direction of the elastic force leaving the dead zone at times when the circuit breaker is in the tripped state; and a stopper fixedly formed on the casing adjacent said toggle link, comprising the step of:

positioning said striking part of said toggle link spaced a distance from said stopper at times when the circuit breaker is in the normal state; and relatively positioning said striking part of said toggle link and said stopper so that said striking part strikes said stopper intermediate in the tripping action to shorten a radius about which a portion of the toggle link pivots, thereby to accelerate the tripping action.

* * * * *